US011549398B2

(12) United States Patent
Kurz-Hardjosoekatmo

(10) Patent No.: US 11,549,398 B2
(45) Date of Patent: Jan. 10, 2023

(54) OIL SYSTEM OF A GAS TURBINE ENGINE

(71) Applicant: Rolls-Royce Deutschland Ltd & Co KG, Blankenfelde-Mahlow (DE)

(72) Inventor: Wolfram Kurz-Hardjosoekatmo, Kleinmachnow (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 17/545,263

(22) Filed: Dec. 8, 2021

(65) Prior Publication Data

US 2022/0186634 A1 Jun. 16, 2022

(30) Foreign Application Priority Data

Dec. 10, 2020 (DE) ..... 10 2020 132 918.0

(51) Int. Cl.
*F01D 25/18* (2006.01)

(52) U.S. Cl.
CPC ..... *F01D 25/18* (2013.01); *F05D 2220/32* (2013.01); *F05D 2260/98* (2013.01)

(58) Field of Classification Search
CPC ..... F01D 25/18; F01D 25/20; F05D 2260/98; F02C 7/14
See application file for complete search history.

(56) References Cited

U.S. PATENT DOCUMENTS 4,696,156 A * 9/1987 Burr ..... B64D 37/34 60/39.08
10,494,951 B2 * 12/2019 Denman ..... F02C 7/06
11,053,815 B2 * 7/2021 Schwarz ..... F01D 25/18
11,131,214 B2 * 9/2021 Menczykalski ..... F01M 1/18
2015/0369082 A1 * 12/2015 Schwarz ..... F01D 25/20 415/177
2019/0316488 A1 * 10/2019 Menczykalski ..... F01M 1/02

FOREIGN PATENT DOCUMENTS

EP 2954212 A2 12/2015
RU 2652867 5/2018
WO 2014123857 A1 8/2014

OTHER PUBLICATIONS

German Search Report dated Jul. 12, 2021 from counterpart German Patent Application No. DE 10 2020 132 918.0.

* cited by examiner

*Primary Examiner* — Eldon T Brockman
(74) *Attorney, Agent, or Firm* — Shuttleworth & Ingersoll, PLC; Timothy J. Klima

(57) ABSTRACT

An oil system of a gas turbine engine, has first and second oil circuits. The oil circuits include. Respectively, first and second oil reservoirs, first and second oil consumers of the engine, and first and second heat exchangers for temperature control. The first oil consumer is impinged with oil from the first oil reservoir. The second oil consumer is impinged with oil from the second oil reservoir. The first oil consumer is connected to the first oil reservoir, and the second oil consumer is connected to the second oil reservoir. The operating temperature of oil in the first oil circuit is lower than in the second oil circuit. The first oil reservoir is connected to the second oil reservoir. Oil from each oil reservoir can be guided into the other oil reservoir via the connection.

11 Claims, 3 Drawing Sheets

OIL SYSTEM OF A GAS TURBINE ENGINE

This application claims priority to German Patent Application DE102020132918.0 filed Dec. 10, 2020, the entirety of which is incorporated by reference herein.

The present disclosure relates to an oil system of a gas turbine engine, having a first oil circuit and having at least a second oil circuit.

Gas turbine engines known in practice are in each case configured having an oil system. An oil system of this type usually comprises an oil tank in which oil for cooling and lubricating various so-called oil consumers of a gas turbine engine is held available. Such oil consumers include inter alia bearing units or gear wheels which are impinged with oil from the oil tank by means of one or a plurality of oil conveying pumps. The oil in the region of the oil consumers absorbs thermal energy. This thermal energy in the region of heat exchangers is again extracted from the oil. To this end, the heat exchangers are disposed inter alia in an airflow that flows through a gas turbine engine. Furthermore known are also heat exchangers in the region of which the oil is temperature-controlled or cooled, respectively, by means of fuel.

When the oil consumers during the operation of a gas turbine engine have different operating temperatures, different requirements in terms of the maximum infeed temperatures of the oil, i.e. hotter or colder, have to be met. The temperature of the oil in the oil tank in this instance in certain circumstances has a value that is set as a function of the temperatures of the volumetric oil flows that are supplied from the oil consumers to the tank. This mixing temperature of the oil in the oil tank as the infeed temperature may be too high or too hot, respectively, for a so-called cold oil consumer of which the operating temperature is lower than the mixing temperature of the oil in the oil tank, while the mixing temperature of the oil in the oil tank as the infeed temperature may be too low or too cold, respectively, for a so-called hot oil consumer of which the oil temperature is significantly higher. As a consequence, a large quantity of heat has to be discharged from the volumetric oil flow by way of which the cold oil consumer is to be supplied.

Since heat exchangers run at relatively low efficiency in the case of relatively low temperature differentials between the medium dissipating thermal energy and the medium absorbing thermal energy, a heat exchanger has to be designed larger than is the case for temperature-controlling a volumetric oil flow of a higher temperature. However, this increases the costs and also the weight of a gas turbine engine.

A so-called warm oil circuit by way of which a hot oil consumer is supplied with oil is optionally operated at an excessively low temperature level, this creating higher losses. These losses are the results of the higher viscosity of the lubricating oil at lower temperatures, this leading to increased undesirable fluidic friction.

In order for the losses to be reduced, a dedicated oil system can be assigned to each oil consumer, this being known from RU 2 652 867 C1, for example. The oil system is proposed for the oil supply of a helicopter gear box and has a main tank and an additional oil tank. Here, oil from the main tank by way of pump units is guided to nozzles and there directed into the interior of the helicopter gear box, the latter representing an oil consumer. Oil from the interior of the helicopter gear box is directed into the additional tank. The oil of the additional tank by way of further pump units and a valve unit is guided to heat exchangers and cooled therein. The oil is directed into the main tank again downstream of the heat exchangers. By way of this oil circuit the helicopter gear box is able to be supplied with oil at a desired operating temperature.

When each oil consumer of a gas turbine engine is supplied with oil by way of such a dedicated oil system, a gas turbine engine has a plurality of separate oil systems or oil circuits, respectively. In this instance, a gas turbine engine is distinguished by a high complexity in terms of engineering and a multiplicity of oil tanks. In order for the oil supply to the individual oil consumers to be guaranteed, the oil levels of the different oil tanks have additionally to be monitored, this causing additional complexity.

It is an object of the present disclosure to provide an oil system of a gas turbine engine that is simple in terms of construction and embodied in a cost-effective manner and by way of which a gas turbine engine is able to be operated at high efficiency and with little complexity.

This object is achieved by an oil system having features as disclosed herein.

The oil system of a gas turbine engine according to the present disclosure has a first oil circuit and at least a second oil circuit. The oil circuits comprise in each case at least one oil reservoir for storing oil, at least one oil consumer of the gas turbine engine, and at least one heat exchanger for temperature-controlling the oil. The oil consumer of the first oil circuit for cooling and lubricating is able to be impinged with oil from the oil reservoir of the first oil circuit. Additionally, the oil consumer of the second oil circuit for cooling and lubricating is able to be impinged with oil from the oil reservoir of the second oil circuit.

Furthermore, for introducing oil into the oil reservoir of the first oil circuit, or into the oil reservoir of the second oil circuit, respectively, the oil consumer of the first oil circuit is connected to the oil reservoir of the first oil circuit, and the oil consumer of the second oil circuit is connected to the oil reservoir of the second oil circuit. The temperature of the oil in the operation of the gas turbine engine in the first oil circuit is lower than in the second oil circuit, the oil consumer of the first oil circuit thus being supplied with the cooler oil while the oil consumer of the second oil circuit is impinged with the oil which has a higher temperature in comparison to the oil in the first oil circuit. Additionally, the first oil reservoir has a connection to the second oil reservoir that in terms of construction is embodied so as to be separate from the first oil reservoir, the oil from the one oil reservoir being able to be guided into the respective other oil reservoir by way of said connection.

In other words, the oil system according to the present disclosure comprises at least two oil circuits which are substantially separated from one another. Oil consumers which in the operation of the gas turbine engine have different operating temperatures are able to be impinged with oil for cooling and lubricating in a simple manner by way of the oil circuits. The oil which is in each case guided from one of the oil reservoirs to an oil consumer has in each case an oil temperature which by way of little complexity causes only a minor loss in terms of efficiency and enables the heat exchangers to be designed with low output and thus to be embodied favorably in terms of installation space and costs.

Since the two oil circuits are mutually connected in the region of the oil reservoirs thereof, the complexity for monitoring the respective oil volumes present in the region of the oil circuits is also minor. As a result, deficient operating states of the oil consumers of the oil circuits are easy to identify, and damage resulting therefrom avoided as a result of corresponding countermeasures.

This is achieved because, as a result of the connection between the two oil reservoirs, oil leakages in the region of one of the two oil circuits can in each case be compensated for with a volumetric oil flow from the respective other oil circuit or oil reservoir, respectively, in a manner which is simple in terms of construction. A potential point in time when damage arises can also thus be delayed at least until corresponding countermeasures by way of which a failure of one of the oil consumers is prevented are initiated.

The connection between the two oil reservoirs in terms of construction can be embodied as a line, as an oil-permeable bulkhead between the two cavities of the oil reservoir that has one or a plurality of passages for the oil, or in any other suitable manner.

In one advantageous refinement of the oil system according to the present disclosure, the oil from the first oil reservoir is able to be guided to the first oil consumer of the gas turbine engine by means of a pump unit. In this instance, the first oil consumer is able to be impinged in a simple manner with an oil quantity, or a volumetric oil flow, respectively, that is adapted to the respective operating point of a gas turbine engine.

If the heat exchanger of the first oil circuit is provided for temperature-controlling the oil between the pump unit and the first oil consumer of the gas turbine engine, the heat exchanger is in each case able to be impinged with a volumetric oil flow that is to be guided through the heat exchanger for temperature-controlling the oil.

The oil from the second oil reservoir can be guided to the second oil consumer of the gas turbine engine by means of a pump unit so as to be able to in each case impinge the oil consumer of the second oil circuit with the required amount of oil as a function of the operating state.

There is additionally the possibility that the heat exchanger of the second oil circuit for temperature-controlling the oil is provided between the pump unit and the oil consumer of the second oil circuit.

In further advantageous embodiments of the oil system according to the present disclosure, the oil from the oil consumer of the first oil circuit is directed into the first oil reservoir, or from the oil consumer of the second oil circuit is directed into the oil reservoir of the second oil circuit, respectively, in each case by means of a further pump unit. In this instance, undesirable accumulations of oil in the region of the oil consumers are avoidable.

There is moreover the possibility that the first oil circuit and the second oil circuit are specified for guiding oil from the second oil circuit in the direction of the oil consumer of the first oil circuit. This is advantageous when the oil consumer of the first oil circuit is more sensitive in relation to deficient operating states in terms of the oil supply.

A further heat exchanger, in the region of which the volumetric oil flow that from the second oil circuit is guided in the direction of the oil consumer of the first oil circuit is temperature-controlled prior to entering the oil consumer of the first oil circuit, can be provided. In this instance, proceeding from the second oil circuit, the oil consumer of the first oil circuit is able to be impinged with oil which has an oil temperature by way of which a gas turbine engine is simple in terms of construction and able to be embodied in a cost-effective manner.

The connection between the oil reservoir of the first oil circuit and the oil reservoir of the second oil circuit can comprise an additional heat exchanger. The oil that is guided from one oil reservoir to the other oil reservoir is able to be guided through the additional heat exchanger prior to entering the respective oil reservoir.

In the region of the additional heat exchanger, oil that from the oil reservoir of the first oil circuit is directed into the oil reservoir of the second oil circuit at a lower temperature is preheated by the oil that from the oil reservoir of the second oil circuit is guided in the direction of the oil consumer of the first oil circuit. At the same time, the volumetric oil flow from the second oil circuit in the direction of the consumer of the first oil circuit is precooled. It is achieved as a result that the oil from the second oil circuit that initially still has an excess of temperature is directed into the first oil circuit at the desired temperature.

Even when the volumetric oil flow that downstream of the oil reservoir of the second oil circuit is guided from the second oil circuit in the direction of the oil consumer of the first oil circuit for the exchange of heat is guided through the additional heat exchanger, the heat exchangers of the oil system by way of which the oil of the first oil circuit and the oil of the second oil circuit are able to be temperature-controlled to the necessary extent are in each case able to be embodied with a low output.

The volumetric oil flow that is guided from the second oil circuit to the oil consumer of the first oil circuit, in a further embodiment of the oil system according to the present disclosure, is initially directed through the additional heat exchanger and subsequently through the further heat exchanger. In this instance, the heat exchangers of the first oil circuit and of the second oil circuit are able to be embodied with a lower output and distinguished by low production costs.

It is self-evident to the person skilled in the art that a feature described with reference to one of the above aspects may be applied to any other aspect, unless these are mutually exclusive. Furthermore, any feature described here may be applied to any aspect and/or combined with any other feature described here, unless these are mutually exclusive.

Preferred refinements are derived from the dependent claims and the description hereunder. Exemplary embodiments of the subject matter according to the present disclosure are explained in greater detail with reference to the drawing, without being restricted thereto. In the drawing:

Figure 1:
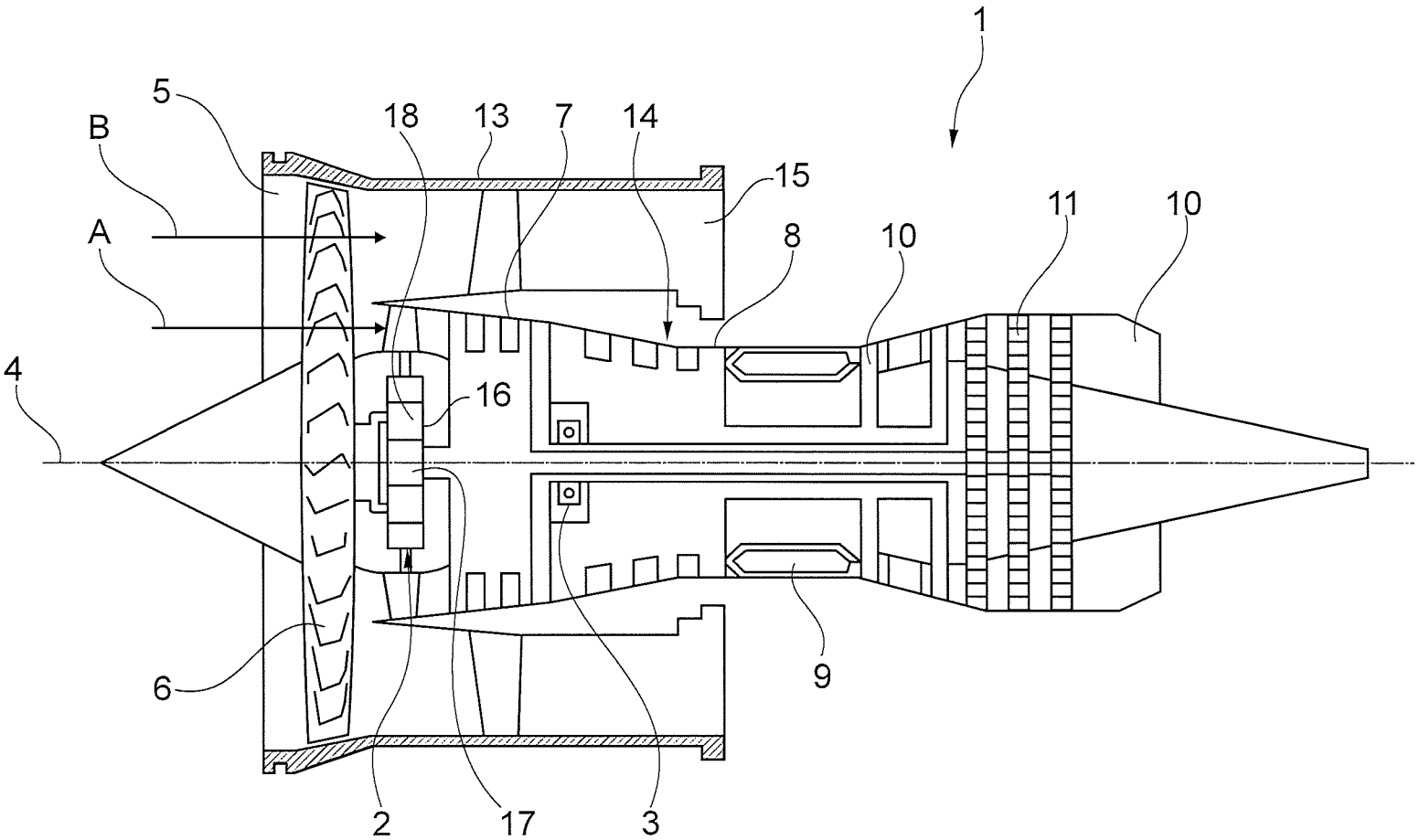
FIG. 1 shows a schematic longitudinal sectional view of a gas turbine engine.

FIG. 1 in an exemplary manner shows a gas turbine engine 1 known per se in a turbofan construction mode having oil consumers such as a gear box 2 and a bearing unit 3. The gas turbine engine 1 has a rotation axis 4. When viewed in the direction of primary flow, the gas turbine engine 1 has an air inlet 5, a fan stage 6 which here can be understood to be part of a low-pressure compressor 7 lying there behind, a high-pressure compressor 8, a combustion chamber 9, a high-pressure turbine 10, a low-pressure turbine 11, and an outlet nozzle 12. A nacelle 13 surrounds the interior of the gas turbine engine 1 and defines the air inlet 5.

The gas turbine engine 1, in a manner known per se, operates in that air entering the air inlet 5 is accelerated by the fan stage 6, wherein two airflows A, B are generated. A first airflow A flows into the low-pressure compressor 7 within a core engine 14. The airflow A is then further compressed by the high-pressure compressor 8 and guided into the combustion chamber 9 for combustion. The hot combustion gases created are relaxed in the high-pressure turbine 10 and the low-pressure turbine 11, wherein said turbines 10, 11 by way of a corresponding shaft system drive the fan stage 6, the low-pressure compressor 7 and the high-pressure compressor 8, and finally exit through the outlet nozzle 12. A second airflow B flows through a bypass flow channel 15 in order to generate the majority of the thrust.

In the turbofan construction mode, the drive of the fan stage 6 in terms of the rotating speed is decoupled from the driving low-pressure turbine 7 by the gear box 2. The gear box 2 is a reduction gear box by way of which the rotating speed of the fan stage 6 is reduced in relation to the rotating speed of the low-pressure turbine 7. The low-pressure turbine 7 can thus be operated more efficiently at relatively high rotating speeds. The fan stage 6 can thus make available more thrust.

The gear box 2 can be configured as an epicyclic gear box, here as a planetary gear box, for example, which during operation has a significant requirement in terms of oil for cooling and lubricating and is surrounded by a casing 16. A sun gear 17 and planetary gears 18 of the gear box 2 are schematically illustrated in FIG. 1. A further component that has to be provided with oil is the bearing unit 3 which is presently configured as a ball bearing and disposed in a bearing chamber.

In other embodiments not illustrated here, the gas turbine engine 1 may be of another construction. The gas turbine engine 1 can thus have a different number of shafts. It is also not mandatory for the gas turbine engine 1 to be configured in a turbofan construction mode.

Figure 2:
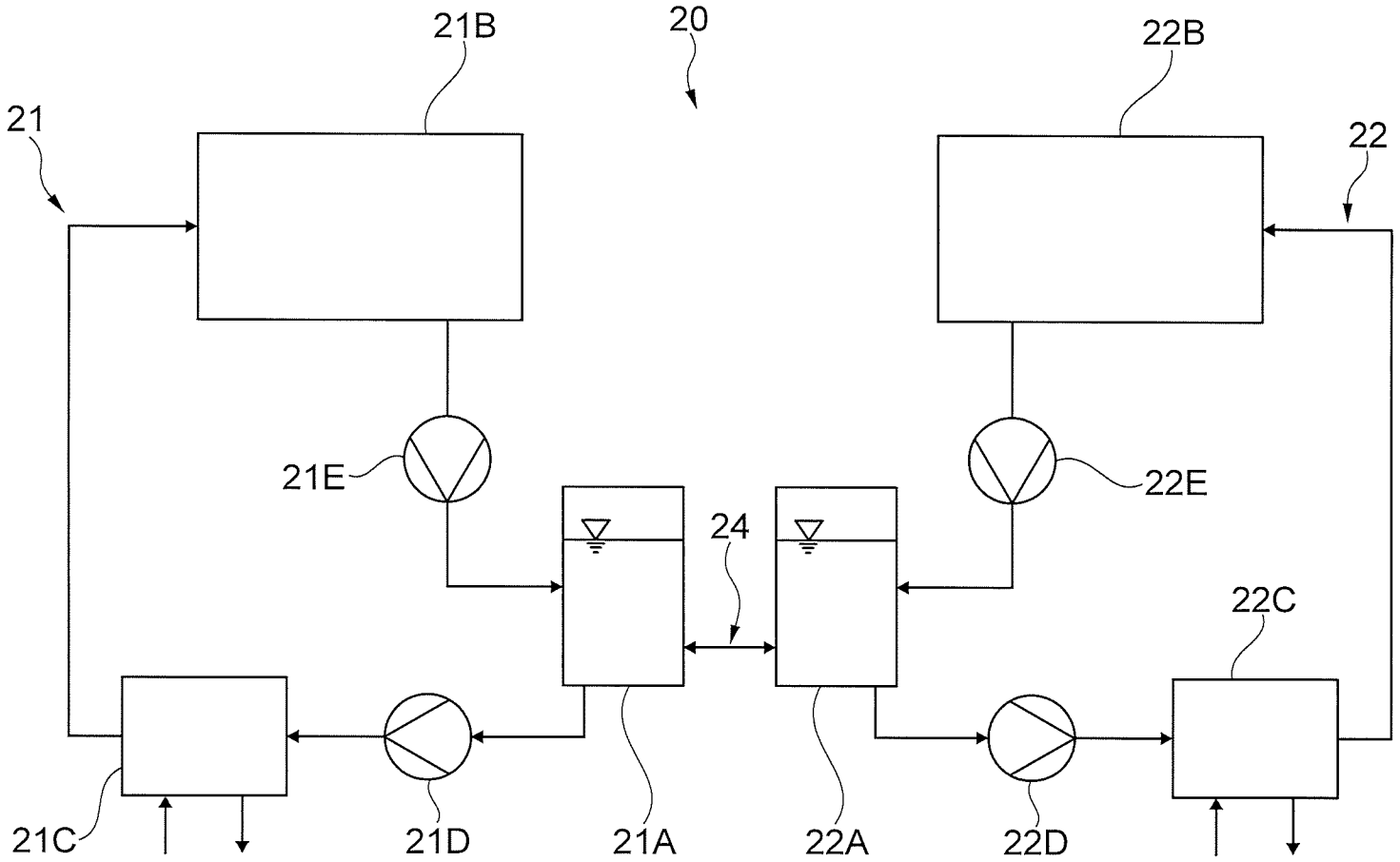
FIG. 2 shows a simplified block diagram of a first exemplary embodiment of an oil system of the gas turbine engine according to FIG. 1.

A simplified block diagram of a first exemplary embodiment of an oil system 20 of the gas turbine engine 1 according to FIG. 1 is illustrated in FIG. 2. The oil system 20 comprises a first oil circuit 21 and a second oil circuit 22. The oil circuits 21, 22 comprise in each case one oil reservoir 21A, 22A for storing oil, at least one oil consumer 21B, 22B of the gas turbine engine 1, and a heat exchanger 21C, 22C. It is possible here that the oil consumer 21B is the gear box 2 of the gas turbine engine 1, for example, while the oil consumer 22B of the second oil circuit 22 may be the bearing unit 3 of the gas turbine engine 1.

The first oil circuit 21 presently represents a so-called cold or cool, respectively, oil circuit of the gas turbine engine 1 in which the oil has in each case a lower operating temperature than in the second oil circuit 22 which can be considered to be a warm or hot oil circuit of the gas turbine engine 1, or of the oil system 20, respectively. In the operation of the gas turbine engine 1, or of the oil system 20, respectively, oil by way of a pump unit 21D is suctioned from the oil reservoir 21A and guided through the heat exchanger 21C of the first oil circuit 21. Downstream of the heat exchanger 21C, the oil consumer 21B is impinged and cooled and lubricated with the oil that is temperature-controlled or cooled, respectively, in the region of the heat exchanger 21C. A further pump unit 21E by means of which oil is retrieved from the oil consumer 21B and directed into the oil reservoir 21A is provided downstream of the oil consumer 21B.

The second oil circuit 22, like the first oil circuit 21, is configured with a pump unit 22C by way of which oil is suctioned from the oil reservoir 22A and guided through the heat exchanger 22C of the second oil circuit 22 in the direction of the oil consumer 22B. The oil consumer 22B of the second oil circuit 22 is cooled and lubricated with the volumetric oil flow that is cooled in the region of the heat exchanger 22C. A further pump unit 22E by means of which oil is retrieved from the oil consumer 22B and directed into the oil reservoir 22A is provided downstream of the oil consumer 22B.

The oil reservoir 21A and the oil reservoir 22A of the two oil circuits 21 and 22 presently have a fluidic connection, wherein oil from the one oil reservoir 21A or 22A is in each case able to be guided into the respective other oil reservoir 22A or 21A by way of the connection that is identified in more detail with the reference sign 24 in FIG. 2. The two oil reservoirs 21A and 22A presently are connected to one another according to the principle of communicating pipes, or communicating vessels, respectively. As a result, the level of the oil, the latter representing a homogeneous liquid, is in each case identical in the two oil reservoirs 21A, 22B as long as the pressures acting in each of the oil reservoirs 21A and 22A are identical and substantially constant.

It is achieved as a result that in the case of an oil leakage in the region of the first oil circuit 21 or in the region of the second oil circuit 22, compensation is in each case achieved by an oil flow to the desired extent from the oil reservoir 21A or from the oil reservoir 22A in the direction of the oil reservoir 22A or in the direction of the oil reservoir 21A.

It is additionally guaranteed as a result of the otherwise separate embodiment of the two oil circuits 21 and 22 that the oil temperature in the first oil circuit 21 and the oil temperature in the second oil circuit 22 can be set to different levels at which the gas turbine engine 1 is able to be operated at the desired high efficiency. Moreover, the heat exchangers 21C and 22C of the two oil circuits 21 and 22 are able to be operated at high efficiency and accordingly able to be designed with a low output, this resulting in a heat exchange surface of the heat exchangers 21C and 22C being able to be embodied smaller in comparison to known solutions. As a result, the heat exchangers 21C and 22C have a low component weight, and there is also little flow loss in the region of the heat exchangers 21C, 22C.

Figure 3:
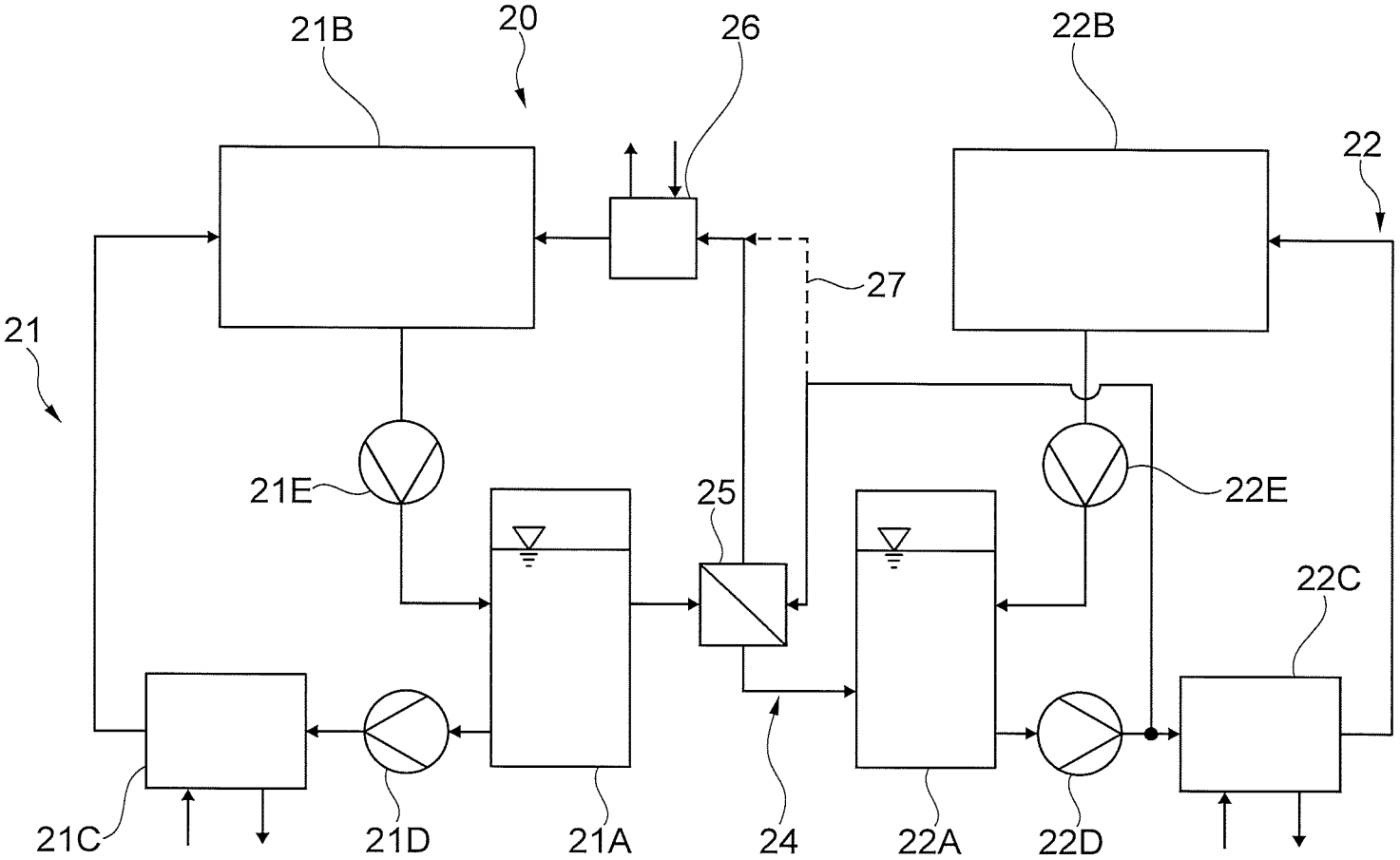
FIG. 3 shows an illustration corresponding to FIG. 2 of a second exemplary embodiment of the oil system.

FIG. 3 shows a view corresponding to FIG. 2 of a further exemplary embodiment of the oil system 20 which differs from the oil system 20 according to FIG. 2 only in some regions. For this reason, only the differences between the oil system 20 according to FIG. 3 and the oil system 20 according to FIG. 2 will be discussed in more detail hereunder, and reference in terms of the fundamental functional mode and of the fundamental constructive design of the oil system 20 according to FIG. 3 is made to the preceding description pertaining to FIG. 2.

The oil system 20 according to FIG. 3 in the region of the connection 24 comprises an additional heat exchanger 25 between the oil reservoir 21A and the oil reservoir 22A. Oil which is in each case guided from the one oil reservoir 21A or 22A to the respective other oil reservoir 22A or 21A is directed through the additional heat exchanger 25. Moreover, a volumetric oil flow is guided through the additional heat exchanger 25, said volumetric oil flow being tapped downstream of the pump unit 22D of the second oil circuit 22 and upstream of the heat exchanger 22C. Downstream of the additional heat exchanger 25, the volumetric oil flow from the second oil circuit 22 is directed into a further heat exchanger 26.

In the region of the further heat exchanger 26 upstream of the oil consumer 21B of the first oil circuit 21, the volumetric oil flow from the second oil circuit 22, by way of which the consumer 21B of the first oil circuit 21 downstream of the further heat exchanger 26 is impinged, is brought to a temperature level at which the oil consumer 21B is cooled and lubricated to the desired extent. The oil from the return of the oil consumer 21B is subsequently guided into the oil reservoir 21A of the first oil circuit 21.

Alternatively thereto, there is also the possibility for the connection 24 between the oil reservoirs 21A and 22A to be configured without the additional heat exchanger 25. The volumetric oil flow that has been tapped between the pump unit 22B and the heat exchanger 22C is then directed directly from the second oil circuit 22 into the further heat exchanger 26, the oil consumer 21B of the first oil circuit 21 being impinged with said volumetric oil flow from there. The last-described flow path of the volumetric oil flow, proceeding from the second oil circuit 22 in the direction of the oil consumer 21B of the first oil circuit 21, is graphically represented by the dashed line 27 in FIG. 3.

In the embodiment of the oil system 20 according to FIG. 3, with the additional heat exchanger 25, the oil reservoir 21A can be disposed above the oil reservoir 22A. In this instance, the oil is guided from the oil reservoir 21A of the first oil circuit 21 and through the additional heat exchanger 25 into the oil reservoir 22A of the second oil circuit 22 solely by virtue of the hydrostatic pressure acting on the oil.

It will be understood that the invention is not limited to the embodiments described above, and various modifications and improvements can be made without departing from the concepts described herein. Any of the features may be used separately or in combination with any other features, unless they are mutually exclusive, and the disclosure extends to and includes all combinations and subcombinations of one or more features which are described here.

LIST OF REFERENCE SIGNS

1 Gas turbine engine
2 Gear box
3 Bearing unit
4 Rotation axis
5 Air inlet
6 Fan stage
7 Low-pressure compressor
8 High-pressure compressor
9 Combustion chamber
10 High-pressure turbine
11 Low-pressure turbine
12 Outlet nozzle
13 Nacelle
14 Core engine
15 Bypass flow channel
16 Casing
17 Sun gear
18 Planet gears
20 Oil system
21 First oil circuit
21A Oil reservoir of the first oil circuit
21B Oil consumer of the first oil circuit
21C Heat exchanger of the first oil circuit
21D Pump unit of the first oil circuit
21E Further pump unit of the first oil circuit
22 Second oil circuit
22A Oil reservoir of the second oil circuit
22B Oil consumer of the second oil circuit
22C Heat exchanger of the second oil circuit
22D Pump unit of the second oil circuit
22E Further pump unit of the second oil circuit
24 Connection
25 Additional heat exchanger
26 Further heat exchanger
27 Line
A First airflow
B Second airflow

The invention claimed is:

1. A oil system of a gas turbine engine, having:

a first oil circuit and having at least one second oil circuit, wherein the first and second oil circuits each comprise at least one oil reservoir for storing oil, at least one oil consumer of the gas turbine engine, and at least one heat exchanger for temperature-controlling the oil, wherein the at least one oil consumer of the first oil circuit for cooling and lubricating is impinged with oil from the at least one oil reservoir of the first oil circuit, and the at least one oil consumer of the at least one second oil circuit for cooling and lubricating is impinged with oil from the at least one oil reservoir of the at least one second oil circuit, wherein for introducing oil, the at least one oil consumer of the first oil circuit is connected to the at least one oil reservoir of the first oil circuit, and the at least one oil consumer of the at least one second oil circuit is connected to the at least one oil reservoir of the at least one second oil circuit, wherein a temperature of the oil in the operation of the gas turbine engine in the first oil circuit is lower than in the at least one second oil circuit, and wherein the oil reservoir of the first oil circuit and the at least one oil reservoir of the at least one second oil circuit have a connection by way of which oil from the one oil reservoir is in each case able to be guided to the respective other oil reservoir.

2. The oil system according to claim 1, wherein the oil from the at least one oil reservoir of the first oil circuit is guided to the at least one oil consumer of the first oil circuit by a pump unit.

3. The oil system according to claim 2, wherein the at least one heat exchanger of the first oil circuit for temperature-controlling the oil is provided between the pump unit and the at least one oil consumer of the first oil circuit.

4. The oil system according to claim 1, wherein the oil from the at least one oil reservoir of the at least one second oil circuit is guided to the at least one oil consumer of the at least one second oil circuit by a pump unit.

5. The oil system according to claim 4, wherein the at least one heat exchanger of the at least one second oil circuit for temperature-controlling the oil is provided between the pump unit and the at least one oil consumer of the at least one second oil circuit.

6. The oil system according to claim 2, wherein the oil from the at least one oil consumer of the first oil circuit is directed into the at least one oil reservoir of the first oil circuit by a further pump unit.

7. The oil system according to claim 4, wherein the oil from the at least one oil consumer of the at least one second oil circuit is directed into the at least one oil reservoir of the at least one second oil circuit by a further pump unit.

8. The oil system according to claim 1, wherein the first oil circuit and the at least one second oil circuit are specified for guiding oil from the at least one second oil circuit in a direction of the at least one oil consumer of the first oil circuit.

9. The oil system according to claim 8, wherein a further heat exchanger, in a region of which a volumetric oil flow that from the at least one second oil circuit is guided in the direction of the at least one oil consumer of the first oil circuit is temperature-controlled prior to entering the oil consumer of the first oil circuit, is provided.

10. The oil system according to claim 8, wherein the connection between the at least one oil reservoir of the first oil circuit and the at least one oil reservoir of the at least one second oil circuit comprises an additional heat exchanger by way of which the oil that from one of the at least one oil reservoirs is guided into a respective other of the at least one oil reservoirs and directed prior to entering the respective other of the at least one oil reservoirs, wherein a volumetric oil flow that downstream of the at least one oil reservoir of the second oil circuit is guided from the at least one second oil circuit in the direction of the at least one oil consumer of the first oil circuit for an exchange of heat is also directed through the additional heat exchanger.

11. The oil system according to claim 10, wherein the volumetric oil flow that from the at least one second oil circuit is guided to the at least one oil consumer of the first oil circuit is initially directed through the additional heat exchanger and subsequently by way of the further heat exchanger.

* * * * *